US009322152B2

(12) United States Patent
Kawamoto

(10) Patent No.: US 9,322,152 B2
(45) Date of Patent: Apr. 26, 2016

(54) SHOWER HEAD

(71) Applicant: Shinichi Kawamoto, Yamaguchi-Ken (JP)

(72) Inventor: Shinichi Kawamoto, Yamaguchi-Ken (JP)

( * ) Notice: Subject to any disclaimer, the term of this patent is extended or adjusted under 35 U.S.C. 154(b) by 161 days.

(21) Appl. No.: 14/302,432

(22) Filed: Jun. 12, 2014

(65) Prior Publication Data

US 2015/0292186 A1 Oct. 15, 2015

(30) Foreign Application Priority Data

Apr. 14, 2014 (TW) ..... 103113580 A

(51) Int. Cl.
*B05B 1/18* (2006.01)
*E03C 1/046* (2006.01)

(52) U.S. Cl.
CPC .. *E03C 1/046* (2013.01); *B05B 1/18* (2013.01)

(58) Field of Classification Search
CPC ..... E03C 1/046
USPC ..... 239/310–379, 463, 468, 490, 499
See application file for complete search history.

(56) References Cited

U.S. PATENT DOCUMENTS 3,788,553 A * 1/1974 Heckman ..... E03C 1/046 239/315
3,964,686 A * 6/1976 Lopez ..... E03C 1/046 239/315
5,961,049 A * 10/1999 Kaps ..... E03C 1/046 239/307
7,093,775 B1 * 8/2006 Bingham ..... B05B 7/2443 139/323
2012/0091231 A1 * 4/2012 Ajagbe ..... B05B 1/18 239/418

* cited by examiner

*Primary Examiner* — Justin Jonaitis
*Assistant Examiner* — Juan C Barrera
(74) *Attorney, Agent, or Firm* — Leong C. Lei

(57) ABSTRACT

The shower head contains a nozzle body and a handle. The nozzle body contains a connecting rod, a support disc, and a container. The container is rotated by water from the handle and its stored liquid soap, essence, or lotion is released by centrifugal force. Water mixed with soap or essence is then ejected from the nozzle head. When the connecting rod is twisted towards a direction, the container is prevented by the support disc from contacting with water and therefore pure water is ejected from the nozzle head. A special flow path is provided in the handle. As water flows through handle, the speed of the water increases and, due to the Venturi effect, outside air is sucked into the handle and mixed with the water, thereby producing a large number of tiny bubbles. The shower head therefore provides a significantly enhanced cleaning effect.

3 Claims, 9 Drawing Sheets

SHOWER HEAD

BACKGROUND OF INVENTION (a) Technical Field of the Invention

The present invention is generally related to shower heads, and more particular to a shower head capable of mixing water with soap and air bubbles.

(b) Description of the Prior Art

Japanese Patent Publication No. 2010-29649 teaches a shower device capable of mixing tiny air bubbles in the water by providing a special flow path in the shower head. The water flow speeds up and the so-called cavitation phenomenon is produced, thereby generating tiny water bubbles in the water.

Japanese Patent Publication No. 2011-98171 teaches a shower device capable of mixing water with essence where an automatic suction device is configured between the shower head and the water pipe to suck and mix essence with water. Specifically, the automatic suction device has a suction inlet configured with a cartridge connection member for installing a cartridge having essence and a filter inside. By the pressure difference resulted from the water flow, essence is sucked and mixed with the water.

As described above, the prior arts teach various means configured inside the shower head or between the shower head and the water heater. They are also capable of mixing air bubbles, essence, lotion, etc., into the water.

However, like Japanese Patent Publication No. 2011-29649 mentioned above, it can only mix air bubbles with the water and cannot add essence or lotion into the water.

The above-mentioned Japanese Patent Publication No. 2003-98171 has the automatic suction device and the cartridge are located between the shower head and the heater. This not only takes up additional space but also requires some installation work. The cost and convenience are both compromised. Additionally, they also reduce the product's visual appearance and present some usage safety issue.

SUMMARY OF THE INVENTION

Therefore, an objective of the present invention is to provide a shower head that can mix not only air bubbles but also essence or lotion with water.

Another objective of the present invention is to provide a shower head where the means for mixing air bubbles and essence is integrated with the shower head itself for enhanced convenience and safety.

Yet another objective of the present invention is to provide a shower head capable of reducing water usage.

To achieve the objectives, the shower head contains a nozzle body and a handle. The nozzle body contains a hollow cylindrical member, a front cap, a connecting rod, a support disc, a container, and a back cap. The handle houses a channel inside from a bottom end to a top end. The top end of the handle is joined adjacent to a lateral side of a circumferential wall of the cylindrical member and water flowing through the channel into the cylindrical member becomes a swirl whose direction is identical to a tightening direction of twisting and joining the back cap to the cylindrical member.

The cylindrical member contains an inlet hole on the circumferential wall for connecting the channel of the handle, and a pair of blocking elements protruding from an inner wall of the cylindrical member where one blocking element is located between the inlet hole and the back cap, and the other blocking element is located oppositely.

The front cap contains a front side perforated with a plurality of outlet holes, a back side joined to the cylindrical member, and an axial element configured from a center toward the back side of the front cap. The axial element has a through channel having threads along an inner wall of the through channel.

The connecting rod housed in the cylindrical member contains a front end running through the front cap and joined to the rotating piece that is capable of being twisted clockwise or counter-clockwise, threads adjacent to the rotating piece and compatible with those on the inner wall of the through channel, and a back end configured with a cone-shaped locking element having a back side whose diameter is larger than that of the connecting rod, thereby forming a flange.

The support disc housed in the cylindrical member contains a front side facing the front cap slanted backward so as to prevent deformation, displacement, or damage to the support disc from the pressure exerted by the connecting rod, a flat back side facing the container, a first protrusion axially extended from a center of the front side, and a second protrusion axially extended backward from a center the back side, and a trough channel runs through the first and second protrusions where the connecting rod runs through the through channel of the support disc. The support disc is displaced along with the movement of the connecting rod and, when the support disc is moved backward, the support disc is stopped by the pair of blocking elements.

The container is hollow, cylindrical in shape, and rotatably housed in the cylindrical member. The container contains a front side facing the front cap, a back side facing the back cap, a plurality of fins slantwise configured along the circumference of the container so that the container is pushed to spin by the swirl of water, a locking notch on the front side of the container having an inner diameter slightly larger than an outer diameter of the second protrusion of the support disc so that the second protrusion is rotatably plugged into the locking notch, a third injection hole at the center of the back side of the container, a support tube surrounding the third injection hole axially extended from the back side of the container, and a release hole adjacent to the rim of the back side of the container where the cone-shaped locking element is embedded into the locking notch. Inside the locking notch, a flange is configured from an inner wall of the locking notch so that the locking element is locked. The container is displaced along with the movement of the connecting rod, and the container is filled with one of liquid soap, essence, and lotion.

The back cap contains a back side, a first injection hole at the center of the back side of the back cap, a front side facing the container, a guide tube surrounding the first injection hole axially extended from the front side of the back cap having a sealed front end, a second injection hole on the front end of the guide tube corresponding to and aligned with the third injection hole of the container, a ball and a spring housed in the guide tube where the ball, by the push of the spring, seals the first injection hole. A back end of the support tube of the container facing the back cap has an inner diameter slightly larger than an outer diameter of the guide tube, and the guide tube is rotatably plugged into the support tube of the container.

As the rotating piece is twisted clockwise or counter-clockwise, the connecting rod moves backward or forward accordingly. Then, by the push or pull of the locking element, the container is displaced. When the container is moved above the inlet hole, it is rotated by the water and liquid soap or essence is released and mixed with water. When the container is moved between the inlet hole and the back cap, the water is prevented by the support disc from contacting with the container. The water is directly ejected from the outlet holes.

A bottom section of the channel has its cross-sectional diameter gradually reduced to a junction where, after the junction, the cross-sectional diameter of the channel becomes a normal size until the channel is connected to the cylindrical member at the inlet hole. The bottom section therefore provides a gradually narrowing aspirator structure. The channel is connected to an elongated slot axially or circumferentially configured on a bottom half of the circumference of the handle via an air channel adjacent to the junction. The air channel is connected adjacent to a bottom end of the slot.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become apparent to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
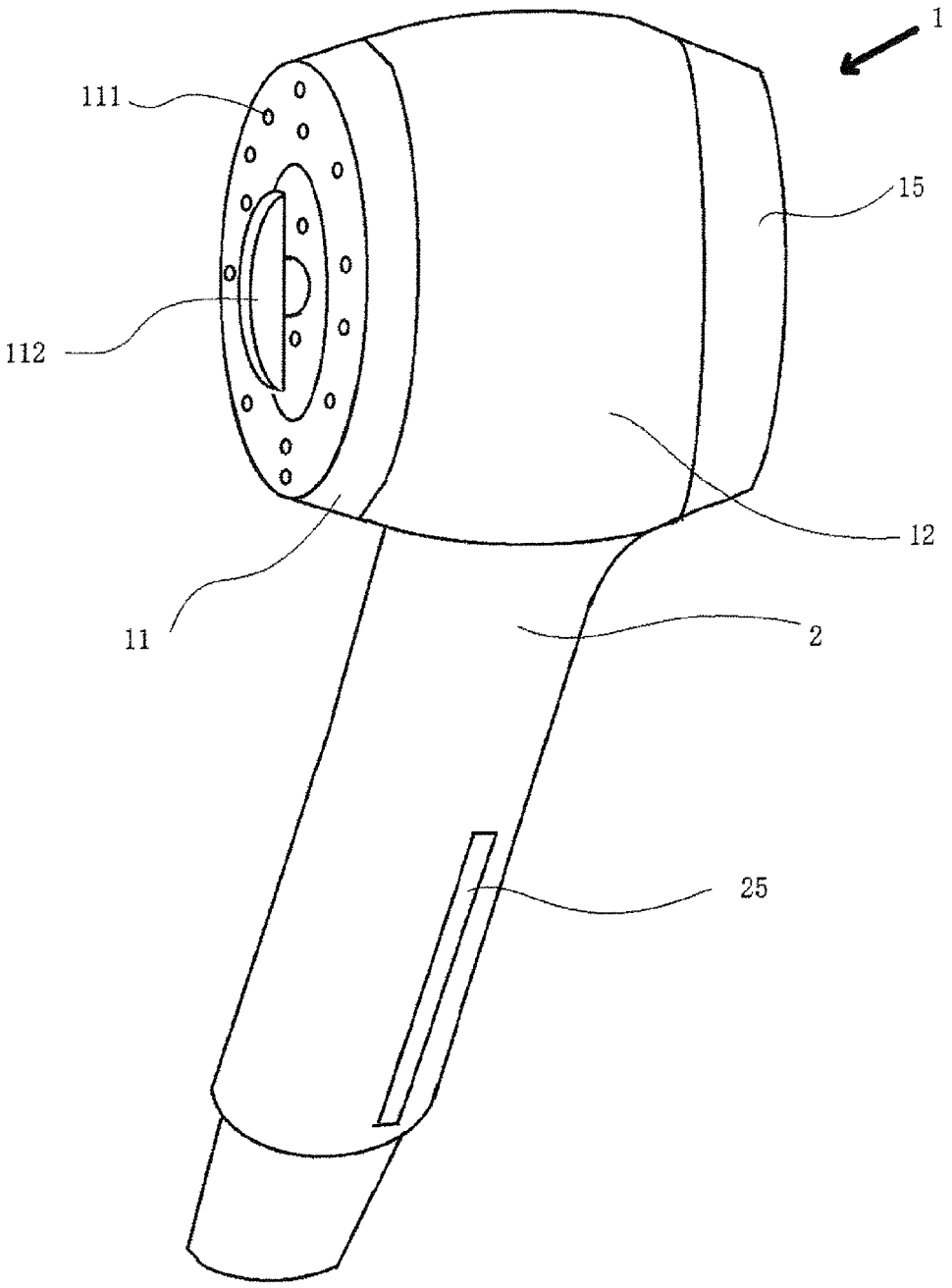
FIG. 1 is a perspective diagram showing the appearance of a shower head according to an embodiment of the present invention.
Figure 2:
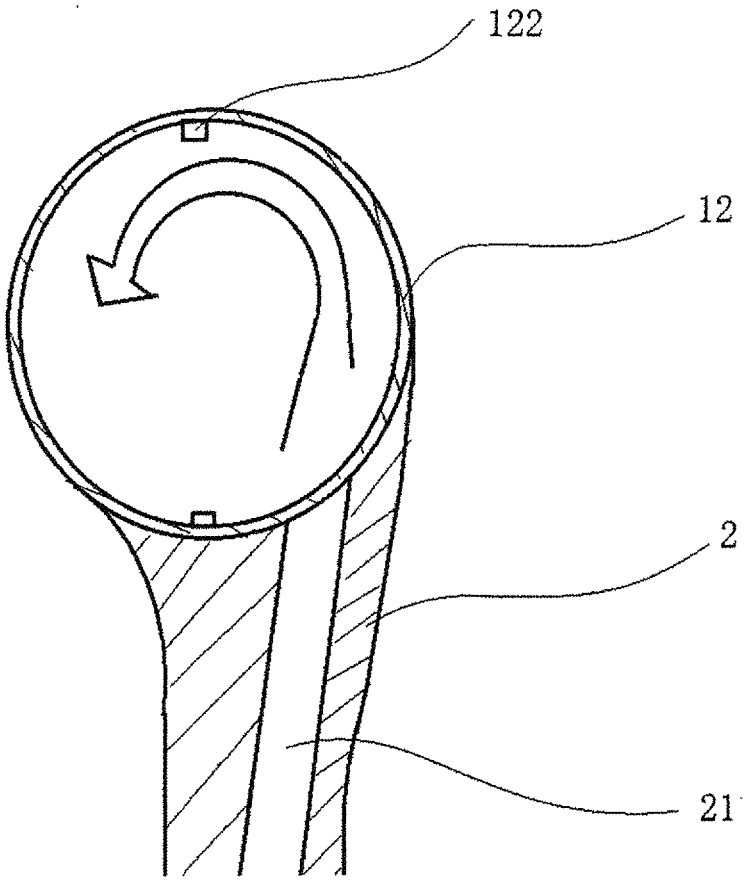
FIG. 2 is a schematic diagram showing a flow path of water through a channel inside a handle and inside a cylindrical member of a nozzle body of the shower head of FIG. 1.

FIG. 1 is a perspective diagram showing the appearance of a shower head according to an embodiment of the present invention. As illustrated, the shower head contains a nozzle body 1 and a handle 2. The nozzle body 1 contains a hollow cylindrical member 12, a front cap 11, and a back cap 15. A top end of the handle 2 is joined to a circumferential wall of the nozzle body 1. The handle 2 has a tubular body housing a channel 21 (as shown in FIG. 2) inside and, by connecting the handle 2 to a pipe (not shown), introduces water from the pipe into the cylindrical member 12. The cylindrical member 12 and the handle 2 can be formed integrally or separately (and then put together afterwards by welding or other means).

FIG. 2 is a schematic diagram showing a flow path of water through the channel 21 inside the handle 2 and inside the cylindrical member 12 of the nozzle body 1 of the shower head of FIG. 1. As illustrated, the handle 2 is joined adjacent to a lateral side of the cylindrical member 12 and, as such, the water flowing through the channel 21 into the cylindrical member 12 will follow the curvature of the cylindrical member's inner wall, thereby becoming a swirl as indicated by the arrow head of FIG. 2. Please note that the direction of the swirl is identical to a tightening direction of twisting the back cap 15. Therefore, the water introduced into the cylindrical member 12 does not relax the tightness of the joint of the back cap 15 to the cylindrical member 12.

Figure 3:
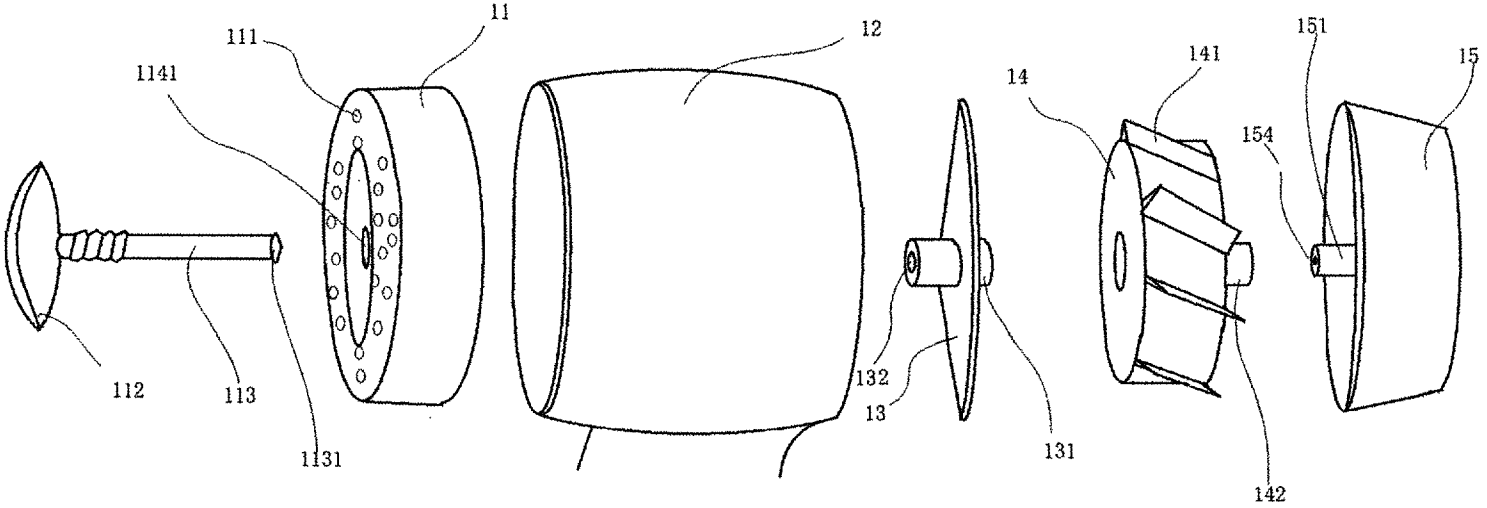
FIG. 3 is a perspective break-down diagram showing the components of the nozzle body of the shower head of FIG. 1.
Figure 4:
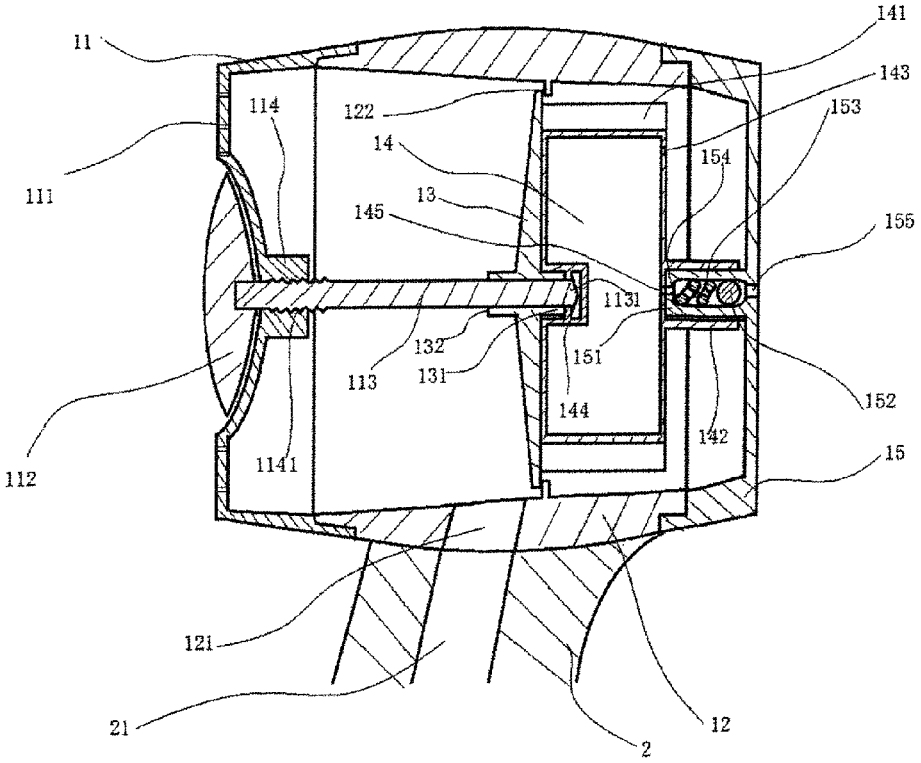
FIG. 4 is a sectional diagram showing an operation scenario of the nozzle body of FIG. 3 where pure water is provided.
Figure 5:
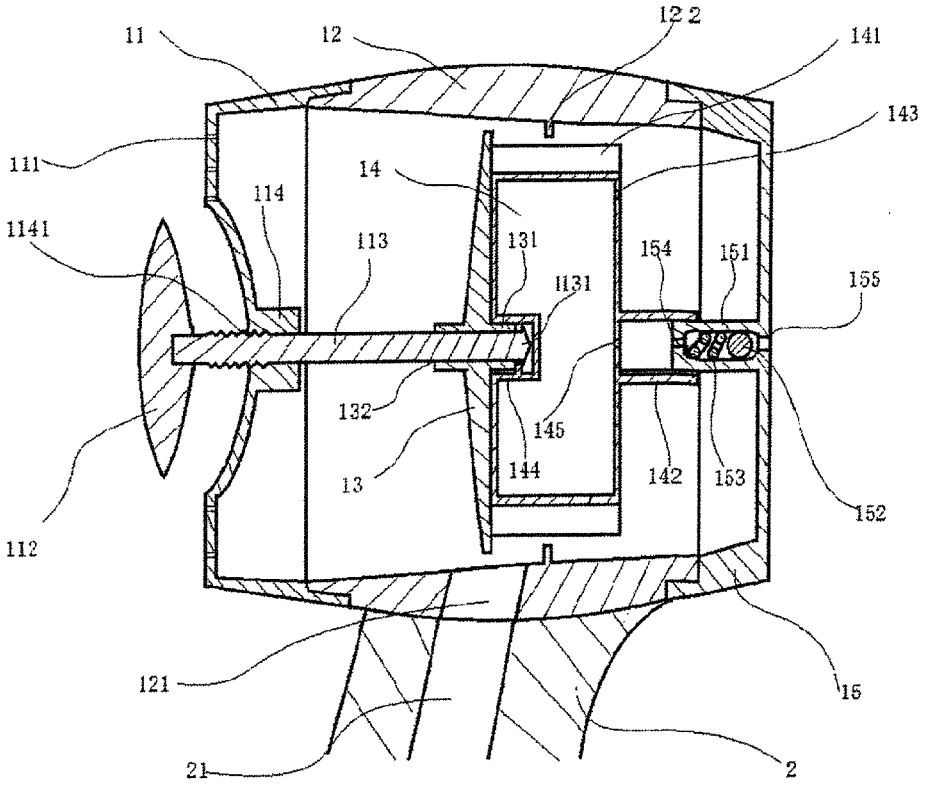
FIG. 5 is a sectional diagram showing another operation scenario of the nozzle body of FIG. 3 where water is mixed with liquid stored in a container.

FIG. 3 is a perspective break-down diagram showing the components of the nozzle body 1 of the shower head of FIG. 1. FIGS. 4 and 5 are sectional diagrams of the nozzle body 1. As illustrated, the nozzle body 1 contains a rotating piece 112, a connecting rod 113, the front cap 11, the cylindrical member 12, a support disc 13, a container 14, and the back cap 15. The cylindrical member 12 has an inlet hole 121 on the circumferential wall for connecting the channel 21 of the handle 2. Protruding from the inner wall of the cylindrical member 12, there is a pair of blocking elements 122. One blocking element 122 is located between the inlet hole 121 and the back cap 15. The other blocking element 122 is located oppositely.

A front side of the front cap 11 is perforated with a number of outlet holes 111 and a back side is joined to the cylindrical member 12. The front side has a central indentation for accommodating the rotating piece 112. From the center of the indentation toward the back side of the front cap 11, an axial element 114 is arranged and the axial element 114 has a through channel 1141 having threads along an inner wall of the through channel 1141.

The rotating piece 112 is joined to a front end of the connecting rod 113. The rotating piece 112 can be twisted clockwise or counter-clockwise by a user's fingers. The connecting rod 113 has threads compatible with those on the inner wall of the through channel 1141, and the threads are configured adjacent to the rotating piece 112. A back end of the connecting rod 113 is configured with a cone-shaped locking element 1131 pointing towards the container 14. The locking element 1131 has a back side whose diameter is larger than that of the connecting rod 113, thereby forming a flange. The connecting rod 113 is threaded through the through channel 1141 of the front cap 11, the support disc 13, and joined to a locking notch 144 of the container 14.

A front side of the support disc 13 facing the front cap 11 is slant backward so as to prevent deformation, displacement, or damage to the support disc 13 from the pressure exerted by the connecting rod 113. A back side of the support disc 13 facing the container 14 is flat. From the centers of the front and back sides of the support discs, protrusions 132 and 131 are configured axially, respectively, and a trough channel runs through the protrusions 132 and 131, allowing the connecting rod 113 to pass through. The connecting rod 113 runs through the through channel of the support disc 13 and the cone-shaped locking element 1131 is embedded into the locking notch 144 of the container 14.

The container 14 is hollow, cylindrical in shape, and rotatably housed in the cylindrical member 12. The container 14 has a number of fins 141 slantwise configured along the circumference of the cylindrical member 12 so that it can be pushed to spin by the swirl of water like a water wheel. The locking notch 144 on a front side of the container 14 has an inner diameter slightly larger than an outer diameter of the protrusion 131 of the support disc 13 so that the protrusion 131 can be rotatably plugged into the locking notch 144. Inside the locking notch 144, a flange is configured from an inner wall of the locking notch 144 so that the locking element 1131 is locked. A back side of the container 14 facing the back cap 15 has a third injection hole 145 in the center. A support tube 142 surrounding the third injection hole 145 is axially extended from the back side of the container 14. There is also a release hole 143 on the container 14's back side adjacent to the rim of the back side.

A back side of the back cap 15 has a first injection hole 155 in the center. A guide tube 151 surrounding the first injection hole 155 is axially extended from a front side of the back cap 15 facing the container 14. A front end of the guide tube 151 facing the container 14 is sealed with a central second injection hole 154 corresponding to and aligned with the third injection hole 145 of the container 14. A ball 152 and a spring 153 are housed in the guide tube 151. The ball 152, by the push of the spring 153, seals the first injection hole 155. To fill liquid into the container 14, an injection tool (not shown) is connected to the first injection hole 155 and liquid is forced into the guide tube 151 through the first injection hole 155 by pushing the ball 152 and compressing the spring 153. The liquid then flows through the second injection hole 154, the third injection hole 145, and finally into the container 14. The injection tool should be familiar to those skilled in the art and its details are omitted here.

The guide tube 151 has another function other than the delivery of liquid. The guide tube 151 allows the container 14 to freely spin around it. More specifically, the support tube 142 has an inner diameter slightly larger than the outer diameter of the guide tube 151 and, as such, the guide tube 151 can be plugged into the support tube 142 and the container 14 is rotatably mounted on the guide tube 151.

The above-described shower head, after its assembly, is depicted in FIGS. 4 and 5. The rotating piece 112 is joined to the front end of the connecting rod 113. The other end of the connecting rod 113 runs through the through channel 1141 of the front cap 11, the support disc 13, and has the locking element 113 joined to the locking notch 144 of the container 14. The support disc 13 has the axial protrusion 131 from its back side and the locking notch 144 has the inner diameter slightly larger than the outer diameter of the protrusion 131. On the other hand, the container 14 has the support tube 142 from its back side and the support tube 14 has the inner diameter slightly larger than the outer diameter of the guide tube 151. As such, the container 14 is rotatably supported by the protrusion 131 of the support disc 13 and the guide tube 151 of the back cap 15, and it is rotated by the swirl produced by the water flowing into the cylindrical member 12. The centrifugal force of the container 14 forces its liquid inside to release from the release hole 143 and to blend with the water in the cylindrical member 12. The water mixed with the liquid is then ejected from the front cap 11.

As shown in FIG. 4, when the rotating piece 112 is twisted clockwise, the connecting rod 113 moves backward toward the back cap 15. As the support disc 13 and the container 14 are also moved backward, the support disc 13 is stopped by the blocking elements 122, and is now located between the inlet hole 121 and the back cap 15. The water flowing into the cylindrical member 12 through the inlet hole 121 therefore is blocked by the support disc 13 and does not mix with the liquid from the container 14. The water not mixed with the liquid is ejected from the outlet holes 111.

As shown in FIG. 5, when the rotating piece 112 is twisted counter-clockwise, the connecting rod 113 moves forward toward the front cap 11. As the support disc 13 and the container 14 are also moved forward, the container 14 is exposed to the water flowing into the cylindrical member 12 through the inlet hole 121, and therefore starts to spin. The centrifugal force of the container 14 forces its liquid inside to release from the release hole 143 and to blend with the water in the cylindrical member 12. Please note that the release hole 143 has a small diameter and the liquid is not released without appropriate centrifugal force.

The liquid in the container 14 can be liquid soap, essence, or lotion. By the simple twisting of the rotating piece 112, the shower head can provide either pure water or soap water. A user can shower with soap water first and then clean up using pure water, only by twisting the rotating piece 112. This convenience is particularly important to senior citizens and people with disabilities. By filling the container 14 with essence, the aroma provides a soothing effect and makes taking shower more interesting.

Figure 6:
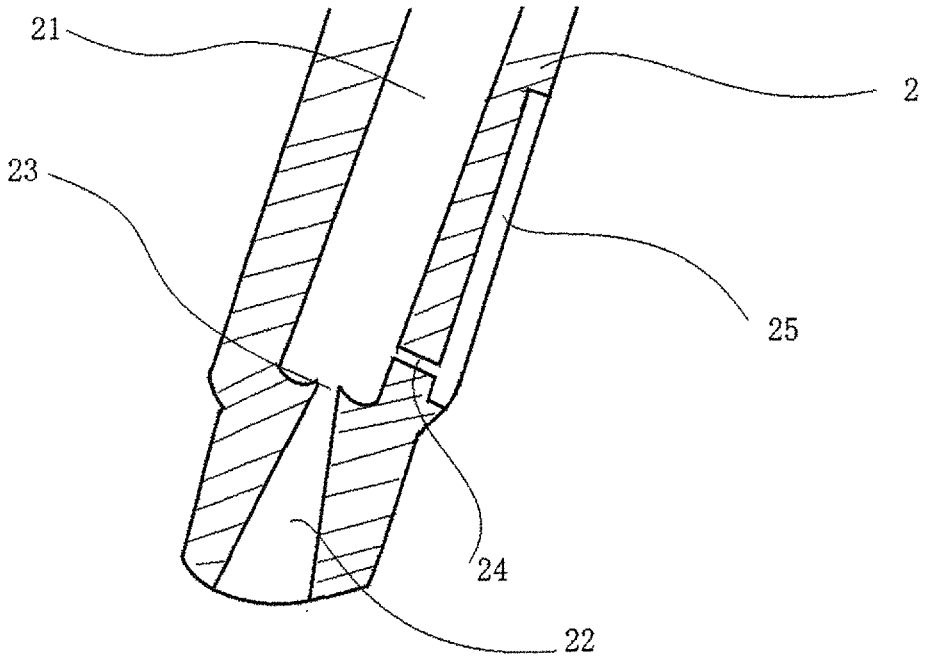
FIG. 6 shows an aspirator structure formed in the channel of the handle of FIG. 2.

As shown in FIG. 6, the handle 2 can provide an aspirator structure as follows. The channel 21 runs from a bottom end of the handle 2 to a top end. A bottom section 22 of the channel 21 has the cross-sectional diameter gradually reduced to a junction 23 where, after the junction 23, the cross-sectional diameter of the channel 21 becomes its normal size until the channel 21 is connected to the cylindrical member 12 at the inlet hole 121. The bottom section 22 therefore provides the gradually narrowing aspirator structure. In addition, the channel 21 is connected to an elongated slot 25 axially configured on a bottom half of the circumference of the handle 2 via an air channel 24 adjacent to the junction 23. The air channel 24 is connected adjacent to a bottom end of the slot 25 so that, when a user holds the handle 2, the air channel 24 is not blocked the user's hand. The length of the slot 25 is therefore determined generally in accordance with the average width of human palm. In alternative embodiments, the slot 25 can also be configured around the circumference of the handle 2 and can achieve similar function.

As water flows through the bottom section 22 and then the junction 23 of the channel 21, the speed of the water increases and, due to the Venturi effect, outside air is sucked into the channel 21 via the air channel 24 and mixed with the water, thereby producing a large number of tiny bubbles. Together with the liquid soap mixed in water, the shower head therefore provides a significantly enhanced cleaning effect. The large number of bubbles in the water can also reduce water usage.

Figure 7:
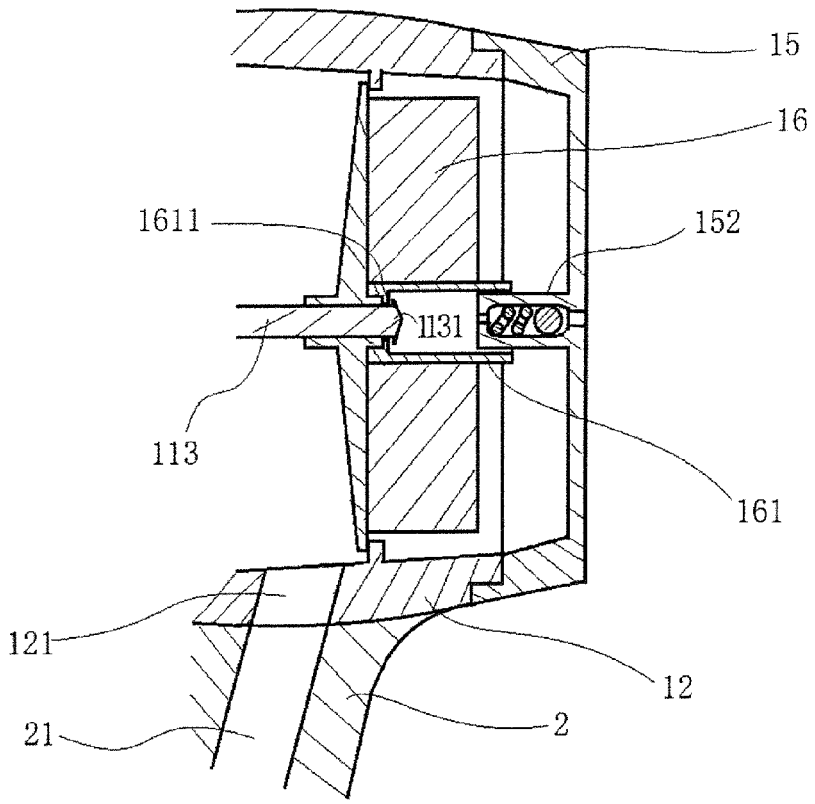
FIG. 7 is a sectional diagram showing a part of a nozzle body of a shower head according to another embodiment of the present invention.
Figure 8:
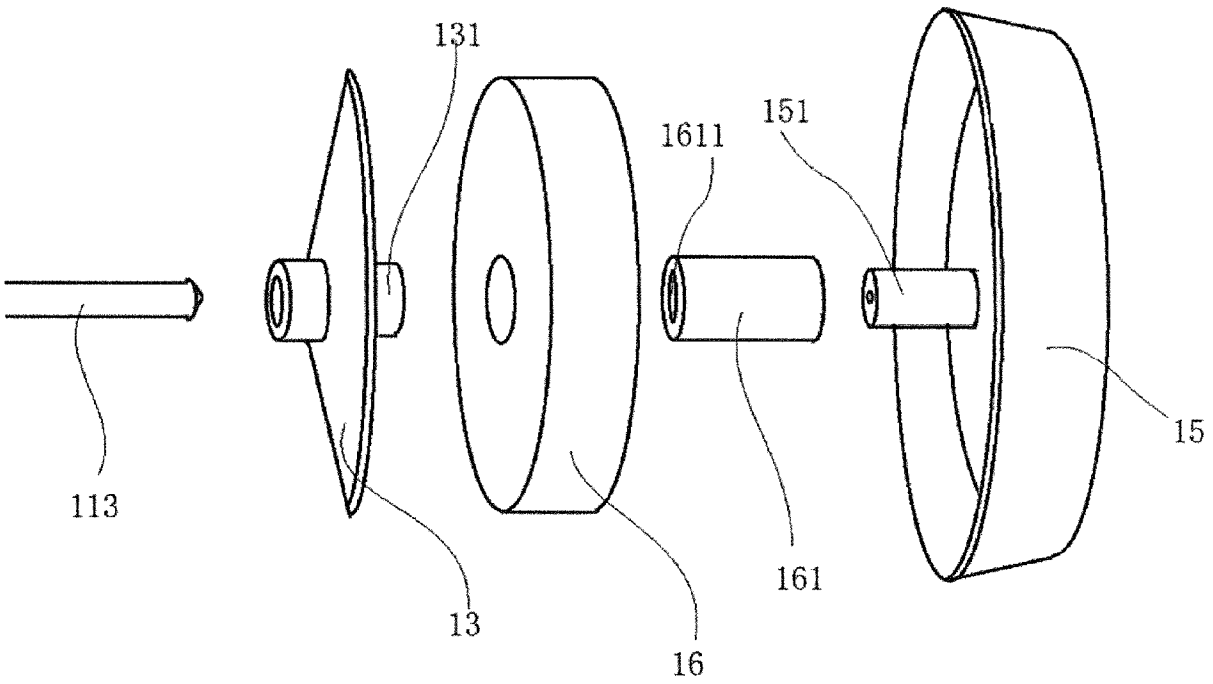
FIG. 8 is a perspective break-down diagram showing the components of the nozzle body of FIG. 7.
Figure 8A:
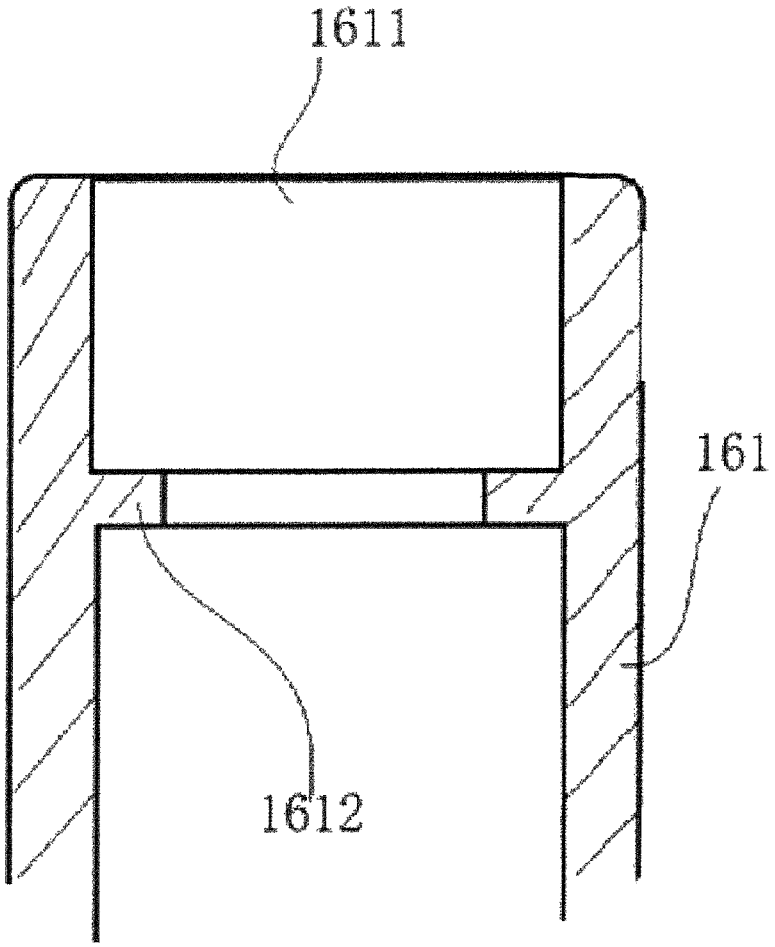
FIG. 8A is an enlarged view of a portion of FIG. 8.

FIGS. 7, 8 and 8A depict another embodiment of the shower head of the present invention. In this embodiment, the container 14 is replaced by a solid object 16 of compatible dimension. The solid object 16 can a soap, essence block, or solidified bath powers. The solid object 16 is threaded axially by a tube 161 through the center of the solid object 16. A back end of the tube 161 facing the back cap 15 has an inner diameter slightly larger than the outer diameter of the guide tube 151, and a front end 1611 of the tube 161 has an inner diameter slightly larger than the outer diameter of the protrusion 131 of the support disc 13. Therefore, the protrusion 131 can be plugged into the front end 1611 of the tube 161, the guide tube 151 can be plugged into the back end of the tube 161, and the solid object 161 can be rotated freely. Additionally, on the inner wall of the tube 161 adjacent to the front end 1611, a flange 1612 is configured so as to lock with the locking element 1131 of the connecting rod 113.

As the rotating piece 112 is twisted clockwise or counter-clockwise, the connecting rod 113 moves backward or forward accordingly. Then, by the push or pull of the locking element 1131, the solid object 16 is displaced. When the solid object 16 is moved above the inlet hole 121, it is rotated and dissolved by the water. When the solid object 16 is moved between the inlet hole 121 and the back cap 15, the water is prevented by the support disc 13 from contacting with the solid object 16. The water is directly ejected from the outlet holes 111.

This second embodiment of the present invention does not alter the structure of the shower head, except that the container 14 is replaced by the solid object 16, and the same showering effect is achieved.

The shower head of the present invention has all mechanisms housed in the shower head itself without installing additional components in the bath room, and therefore is convenient, safe, simple to operate, efficient in terms of space required, and more effective in terms of cleaning. By adding different liquid soap, essence, or lotion in the container 14, or replacing the container 14 with slid soap, bath powders, etc., taking shower can also be fun and soothing.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A shower head, comprising a nozzle body and a handle; wherein the nozzle body comprises a hollow cylindrical member, a front cap, a connecting rod, a support disc, a container; and a back cap; the handle houses a channel inside from a bottom end to a top end; the top end of the handle is joined adjacent to a lateral side of a circumferential wall of the cylindrical member and water flowing through the channel into the cylindrical member becomes a swirl whose direction is identical to a tightening direction of twisting and joining the back cap to the cylindrical member; the cylindrical member comprises an inlet hole on the circumferential wall for connecting the channel of the handle, and a pair of blocking elements protruding from an inner wall of the cylindrical member where one blocking element is located between the inlet hole and the back cap, and the other blocking element is located oppositely; the front cap comprises a front side perforated with a plurality of outlet holes, a back side joined to the cylindrical member, and an axial element configured from a center toward the back side of the front cap; the axial element has a through channel having threads along an inner wall of the through channel; the connecting rod housed in the cylindrical member comprises a front end running through the front cap and joined to a rotating piece that is capable of being twisted clockwise or counter-clockwise, threads adjacent to the rotating piece and compatible with those on the inner wall of the through channel, and a back end configured with a cone-shaped locking element having a back side whose diameter is larger than that of the connecting rod, thereby forming a flange; the support disc housed in the cylindrical member comprises a front side facing the front cap slanted backward so as to prevent deformation, displacement, or damage to the support disc from the pressure exerted by the connecting rod, a flat back side facing the container, a first protrusion axially extended from a center of the front side, and a second protrusion axially extended backward from a center the back side, and a through channel runs through the first and second protrusions where the connecting rod runs through the through channel of the support disc; the support disc is displaced along with the movement of the connecting rod; and, when the support disc is moved backward, the support disc is stopped by the pair of blocking elements; the container is hollow, cylindrical in shape, and rotatably housed in the cylindrical member; the container comprises a front side facing the front cap, a back side facing the back cap, a plurality of fins slantwise configured along the circumference of the container so that the container is pushed to spin by the swirl of water, a locking notch on the front side of the container having an inner diameter slightly larger than an outer diameter of the second protrusion of the support disc so that the second protrusion is rotatably plugged into the locking notch, a third injection hole at the center of the back side of the container, a support tube surrounding the third injection hole axially extended from the back side of the container, and a release hole adjacent to the rim of the back side of the container where the cone-shaped locking element is embedded into the locking notch; inside the locking notch, a flange is configured from an inner wall of the locking notch so that the locking element is locked; the container is displaced along with the movement of the connecting rod; and the container is filled with one of liquid soap, essence, and lotion; and the back cap comprises a back side, a first injection hole at the center of the back side of the back cap, a front side facing the container, a guide tube surrounding the first injection hole axially extended from the front side of the back cap having a sealed front end, a second injection hole on the front end of the guide tube corresponding to and aligned with the third injection hole of the container, a ball and a spring housed in the guide tube where the ball, by the push of the spring, seals the first injection hole; a back end of the support tube of the container facing the back cap has an inner diameter slightly larger than an outer diameter of the guide tube; and the guide tube is rotatably plugged into the support tube of the container.

2. The shower head according to claim 1, wherein a bottom section of the channel has its cross-sectional diameter gradually reduced to a junction where, after the junction, the cross-sectional diameter of the channel becomes a normal size until the channel is connected to the cylindrical member at the inlet hole; the bottom section therefore provides a gradually narrowing aspirator structure; the channel is connected to an elongated slot axially or circumferentially configured on a bottom half of the circumference of the handle via an air channel adjacent to the junction; and the air channel is connected adjacent to a bottom end of the slot.

3. A shower head, comprising a nozzle body and a handle; wherein the nozzle body comprises a hollow cylindrical member, a front cap, a connecting rod, a support disc, a solid object, and a back cap; the handle houses a channel inside from a bottom end to a top end; the top end of the handle is joined adjacent to a lateral side of a circumferential wall of the cylindrical member and water flowing through the channel into the cylindrical member becomes a swirl whose direction is identical to a tightening direction of twisting and joining the back cap to the cylindrical member; the cylindrical member comprises an inlet hole on the circumferential wall for connecting the channel of the handle, and a pair of blocking elements protruding from an inner wall of the cylindrical member where one blocking element is located between the inlet hole and the back cap, and the other blocking element is located oppositely; the front cap comprises a front side perforated with a plurality of outlet holes, a back side joined to the cylindrical member, and an axial element configured from a center toward the back side of the front cap; the axial element has a through channel having threads along an inner wall of the through channel; the connecting rod housed in the cylindrical member comprises a front end running through the front cap and joined to a rotating piece that is capable of being twisted clockwise or counter-clockwise, threads adjacent to the rotating piece and compatible with those on the inner wall of the through channel, and a back end configured with a cone-shaped locking element having a back side whose diameter is larger than that of the connecting rod, thereby forming a flange; the support disc housed in the cylindrical member comprises a front side facing the front cap slanted backward so as to prevent deformation, displacement, or damage to the support disc from the pressure exerted by the connecting rod, a flat back side facing the sold object, a first protrusion axially extended from a center of the front side, and a second protrusion axially extended backward from a center the back side, and a through channel runs through the first and second protrusions where the connecting rod runs through the through channel of the support disc; the support disc is displaced along with the movement of the connecting rod; and, when the support disc is moved backward, the support disc is stopped by the pair of blocking elements; the solid object is cylindrical in shape, and rotatably housed in the cylindrical member; the solid object comprises a tube threaded axially through the center of the solid object where a front end of the tube has an inner diameter slightly larger than the outer diameter of the second protrusion of the support disc so that the second protrusion is rotatably plugged into the front end of the tube; on the inner wall of the tube adjacent to the front end, a flange is configured so as to lock with the locking element of the connecting rod; the solid object is displaced along with the movement of the connecting rod; and the solid object is one of a soap, essence block, and solidified bath powers; the back cap comprises a back side, a front side facing the solid object, and a guide tube axially extended from the front side of the back cap where a back end of the tube of the solid object facing the back cap has an inner diameter slightly larger than the outer diameter of the guide tube; and the guide tube is rotatably plugged into the tube of the solid object.

* * * * *